US005425509A

United States Patent [19]

Van Severen et al.

[11] Patent Number: 5,425,509

[45] Date of Patent: Jun. 20, 1995

[54] SPOOL FILLED WITH ELONGATED METAL ELEMENT

[75] Inventors: Bernard Van Severen, Harelbeke; Willy Coopman; John Verhaeghe, both of Deerlijk, all of Belgium

[73] Assignee: N.V. Bekaert S.A., Zwevegem, Belgium

[21] Appl. No.: 79,871

[22] Filed: Jun. 23, 1993

[30] Foreign Application Priority Data

Jul. 9, 1992 [EP] European Pat. Off. ..... 92202092

[51] Int. Cl.[6] ..... B65H 54/00; B65H 51/015

[52] U.S. Cl. ..... 242/164; 242/172; 242/18 EW; 242/25 R

[58] Field of Search ..... 242/164, 165, 172, 18 EW, 242/25 R; 140/102, 149

[56] References Cited

U.S. PATENT DOCUMENTS 4,936,358 6/1990 Verhaeghe et al. ..... 140/149

FOREIGN PATENT DOCUMENTS 0200121 11/1986 European Pat. Off. .

2283848 4/1976 France .

187936 11/1906 Germany ..... 242/18 EW

*Primary Examiner*—Daniel P. Stodola

*Assistant Examiner*—Michael R. Monsen

*Attorney, Agent, or Firm*—Foley & Lardner

[57] ABSTRACT

A spool (10) is filled with an elongated metal element (12) which is wound onto the spool with a plurality of windings. The plurality of windings end with a final winding (22) and n windings (24) preceding the final winding ("n preceding windings"), n is hereby greater than or equal to one. The final winding (22) comprises a beginning part (26), a middle part (28) and a trailing end (20). The middle part (28) is under the n preceding windings (24) in order to secure the final winding to the rest of the elongated element. The beginning part (26) and the trailing end (20) are at the same side of the n preceding windings (24).

19 Claims, 3 Drawing Sheets

SPOOL FILLED WITH ELONGATED METAL ELEMENT

BACKGROUND OF THE INVENTION

The invention relates to a spool filled with an elongated metal element which is wound onto the spool with a plurality of windings. The term "spool" also refers to a bobbin and/or a reel. The spool may be made of metal or of a synthetic material. The invention also relates to a method of and an apparatus for winding an elongated element in a plurality of windings onto a spool.

Elongated metal elements such as steel wires, non-ferro wires and steel cords are conveniently wound on spools for storage at the wire or cord manufacturers and for transport to the customers.

During the past ten years continuous efforts have been made to automate the process of winding elongated metal elements on a spool, including the step of fixing the trailing end of the elongated element, i.e. the end of the elongated element at full spool.

The design of the spool and/or the process of winding must fulfill a plurality of requirements in order to be automated appropriately.

A first requirement is that no damaging on the elongated element must occur during the winding process and during the finishing of the winding process.

A second requirement is that waste of the elongated element is to be avoided. This means that, after being unwound, the elongated element should be used over its entire length, i.e. from the trailing end (the cord end at full spool) to the cord end at empty spool.

A third requirement is that fixing means used to fix the trailing end during the winding process must not lead to residual products which fall on the floor during the subsequent unwinding process and which pollute the working environment.

A fourth requirement is that no time losses must occur during winding and unwinding. This means that the fixing and unfixing of the trailing end should be done in a short time period.

Still another requirement is that the great mass of existing metal spools now in use, should be preferably used—with or without some necessary adaptations—in the eventually automated process.

Despite continuous efforts in the field, it has been found difficult to meet all of the above-mentioned requirements and to develop a spool and a winding process that can be automated.

SUMMARY OF THE INVENTION

It is an object of the present invention to provide a spool and a process of winding the spool whereby the spool and the process are such that the process can be automated, that no damages on the elongated element occur, that waste of the elongated element is avoided, that residual products which pollute the working environment are avoided, that no great time losses occur and that the great mass of existing metal spools can still be used.

According to a first aspect of the present invention, there is provided a spool filled with an elongated metal element which is wound onto the spool with a plurality of windings. The elongated metal element has a bending stiffness which is greater than 10 $Nmm^2$, preferably greater than 100 $Nmm^2$, e.g. about 150 $Nmm^2$, as measured by the Taber stiffness tester.

The plurality of windings end with a final winding and n windings preceding the final winding (hereafter called the "n preceding windings"). The number n is herein greater than or equal to one. The final winding comprises a beginning part, a middle part and a trailing end. The middle part is under one or more of the n preceding windings in order to secure the final winding to the rest of the elongated element. The beginning part and the trailing end are at the same side of the n preceding windings.

An advantage of the spool according to the invention is that no additional fixing means ought to be used so that pollution of the working environment is completely avoided.

Another advantage is that the final winding may be easily released: a simple and short pull on the trailing end suffices to free the final winding from under the n preceding windings and the unwinding process is ready to start. No elongated element is hereby wasted.

The number n of preceding windings is greater than or equal to one, preferably greater than or equal to two, for example, greater than or equal to four. On the one hand, a sufficient number of windings should be provided in order to secure the fixing of the final winding during storage and during transport. On the other hand, the number of windings should not exceed a maximum allowable limit, since releasing the final winding with a small pull should still remain possible. In this sense, the number of n preceding windings must not exceed ten to twelve, depending upon the kind of elongated element which is to be wound.

The tension in the n preceding windings should be such that, on the one hand, fixing is secured during handling and transport, and, on the other hand, releasing the final winding with a small pull is possible.

The final winding of the elongated metal element has a radius of curvature on the filled spool which is at least 45 mm, preferably at least 60 mm. e.g. at least 80 mm or 100 mm. Smaller radii of curvature would lead to elongated metal elements with plastically deformed final windings, which means that the final winding is no longer useable.

The middle part of the final winding extends under at least one of the n preceding windings over an angle which is greater than 90°, e.g. greater than 135° or 180°, this angle being measured from the axis of the spool. Smaller angles would again lead to elongated metal elements with plastically deformed final windings, which means that the elongated metal element is no longer useable over its entire length.

The final winding of the elongated metal element has no parts which have been plastically deformed in one or another way during the winding process: only an elastic deformation has taken place. Moreover, no other damage on the elongated element has taken place. Hence, the elongated metal element is useable from the very trailing end at the full spool.

The distance between two subsequent windings in the spool, as measured parallel with the central axis of the spool, can be smaller than 10 mm, and may be about 4–5 mm. Preferably, the n preceding windings are adjacent to each other.

Preferably, the trailing end of the elongated element is not longer than 50 cm, e.g. smaller than 35 cm or 25 cm.

The spool has a filling degree which is smaller than 78 per cent, e.g. smaller than 70 per cent, where the filling degree is defined as the cross-sectional surface of the elongated metal element divided by the cross-sectional surface needed by the elongated metal element on the spool. The elongated metal element has a specific gravity of at least 7 kg/dm$^3$.

According to a second aspect of the present invention, there is provided a method of winding an elongated metal element in a plurality of windings onto a spool. The plurality of windings end with a final winding and n preceding windings. The number n is greater than or equal to one. The final winding comprises a beginning part, a middle part and a trailing end.

The method comprises the steps of:

(i) increasing the length of the n preceding windings while maintaining the tension in the n preceding windings in order to create a space between the n preceding windings and the rest of the elongated element;

(ii) holding the trailing end of the final winding fixed;

(iii) gripping the middle part of the final winding;

(iv) bringing the middle part of the final winding under the n preceding windings, in the space between the n preceding windings and the rest of the elongated element;

(v) decreasing the length of the n preceding windings while maintaining the tension in the n preceding windings in order to secure the final winding to the rest of the elongated element;

(vi) releasing the middle part of the final winding.

The tension is usually greater than 10N and smaller than 100N. The minimum value is dictated by reasons of securing the fixing during handling and transport. The maximum value is dictated by reasons of easily releasing of the final winding. Normally the tension is smaller one third of the breaking load of the elongated metal element.

The numbering of the different steps (i) to (v) does not necessarily mean that the different steps occur in the numbered sequence. As a matter of example only holding the trailing end of the final winding fixed—step (ii)—may occur before increasing the length of the n preceding windings—step (i). However, step (iv) necessarily occurs after steps (i), (ii) and (iii), and steps (v) and (vi) necessarily occur after step (iv).

As will become clear from the detailed description hereinafter, the above-mentioned method comprises steps which may all be automated.

Step (i)—increasing the length of the n preceding windings —may be carried out in several ways.

A first way is to provide holding means which are located radially outward of the spool and to wind the n preceding windings over these holding means.

A second way comprises following steps:

(a) providing holding means which are located radially outward of the spool;

(b) positioning said holding means under the trailing end;

(c) rotating said holding means relatively to the spool in the winding direction over n+1 turns;

(d) moving the final winding from said holding means so that only the n preceding windings remain on said holding means.

Step (v)—decreasing the length of the n preceding windings —may be done by rotating the spool relatively to the final winding in the winding direction.

According to a third aspect of the present invention, there is provided an apparatus for winding an elongated element in a plurality of windings onto a spool. The plurality of windings end with a final winding and n preceding windings. The number n is greater than or equal to one. The final winding comprises a beginning part, a middle part, and a trailing end.

The apparatus comprises:

means for holding the trailing end fixed:

means for increasing the length of the n preceding windings:

means for gripping and releasing the middle part of the final winding; and means for decreasing the length of the n preceding windings.

The means for gripping and releasing the middle part of the final winding are different from the means for increasing the length of the n preceding windings.

BRIEF DESCRIPTION OF THE DRAWINGS

The invention will now be described with respect to the accompanying drawings wherein.

DESCRIPTION OF THE PREFERRED EMBODIMENTS

Figure 1:
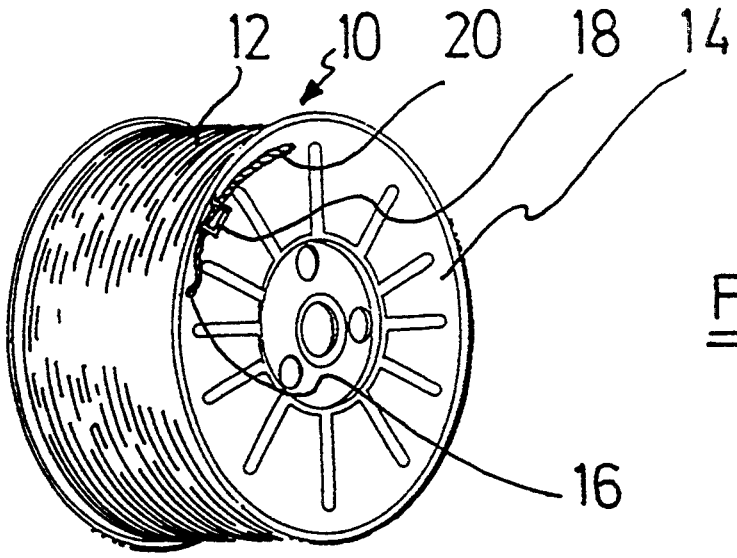
FIG. 1 shows a spool according to the prior art.

FIG. 1 shows a spool 10 according to the prior art. The spool 10 comprises a plurality of windings of an elongated metal element 12. The spool 10 has two flanges 14. At least one of these flanges 14 comprises a hole 16 located near the radially outer border of the flange 14. A clamp 18 is fixed to the outer side of the flange 14 near the hole 16. The trailing end 20 of the elongated element 12 has been put through the hole 18 and is hold by means of the clamp 18.

Figure 2:
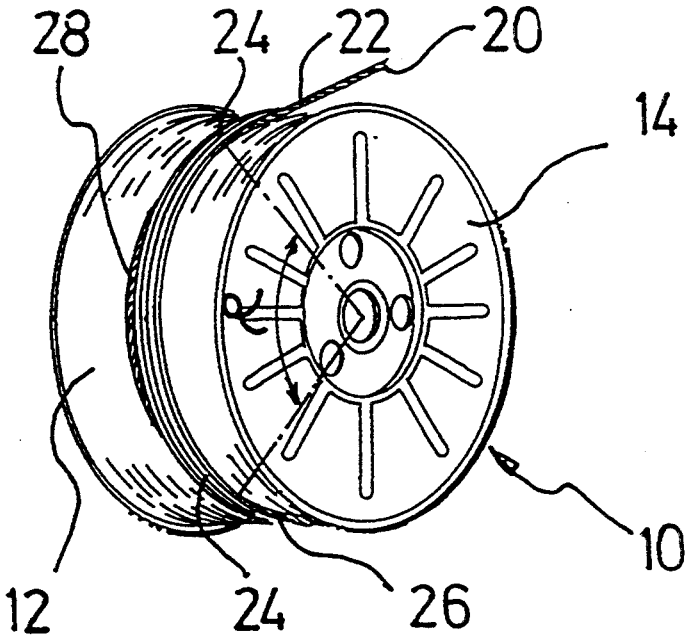
FIG. 2 shows a spool according to the first aspect of the present invention.
Figure 3:
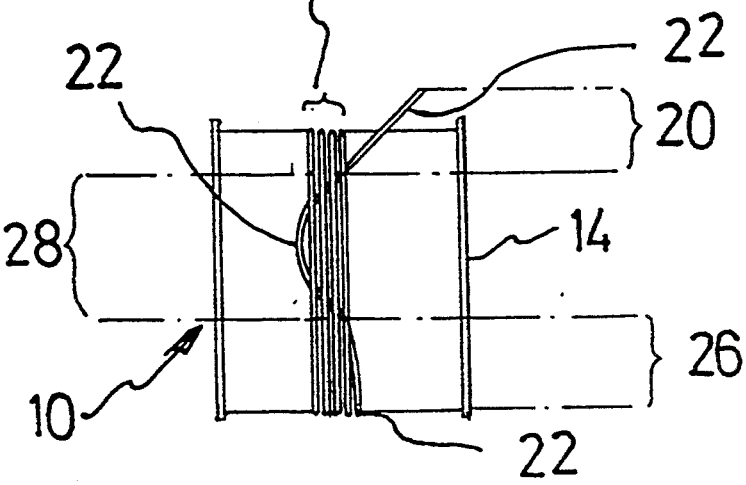
FIG. 3 shows schematically a spool according to the first aspect of the present invention.

FIGS. 2 and 3 show a spool 10 according to the first aspect of the present invention. FIG. 3 is a more simplified and schematical drawing made to simplify and clarify.

If the elongated metal element wound on the spool is a steel cord, the diameter of the flanges of the spool is about 250 mm. The distance between the flanges may be between 150 and 320 mm. The capacity of these spools is from 15 to 40 kg of steel cord.

When filled with an elongated metal element, the outer diameter of the flanges is still somewhat greater than the outer diameter of the last windings of elongated element.

The elongated metal element has a bending stiffness which is greater than 10 Nmm$^2$, preferably greater than 100 Nmm$^2$. Examples of bending stiffnesses for convential steel cord structures are as follows:

251 Nmm$^2$ for a 2+2×0.25

174 Nmm$^2$ for a 4×0.25

178 Nmm$^2$ for a 4×0.25 OC (open cord)

190 Nmm$^2$ for a 1+4×0.25

200 Nmm$^2$ for a 2×0.30 HT (high tensile)

225 Nmm$^2$ for a 5×0.25

360 $Nmm^2$ for a $2+7\times0.22$

All these bending stiffnesses have been measured by means of the known Taber stiffness tester.

The plurality of windings 12 on the spool 10 end with a final winding 22 and four windings 24 which preceed the final winding 22 (hereinafter called the "four preceding windings"). The final winding 22 comprises a beginning part 26, a middle part 28 and a trailing end 20. The middle part 28 is secured under at least one of the four preceding windings 24 to the rest of the elongated element 12. The beginning part 26 and the trailing end 20 of the final winding 22 are at the same side of the four preceding windings 24 and are not covered by the preceding windings 24. A small, short pull is sufficient to free the final winding 22.

The middle part 28 extends under at least one of the four preceding windings 24 over an angle $\alpha$ which is greater than 90°. Nor the middle part 28 nor any other part of the final winding 22 forms a sharp curve (FIG. 3 is exaggerated in order to clearly show the different parts of the final winding 22). The final winding has not been plastically deformed and has not been damaged in another way.

An advantage of a spool according to FIGS. 2 and/or 3 with respect to a spool according to FIG. 1, is that there is no need any more to keep the hole 16 free and uncovered. This means that one and the same spool 10 can have more weight of elongated element 12 since it can now be filled up to the outer border of the flanges 14.

Another advantage of a spool according to FIGS. 2 and/or 3 with respect to a spool according to FIG. 1, will be explained with reference to FIG. 4.

Figure 4:
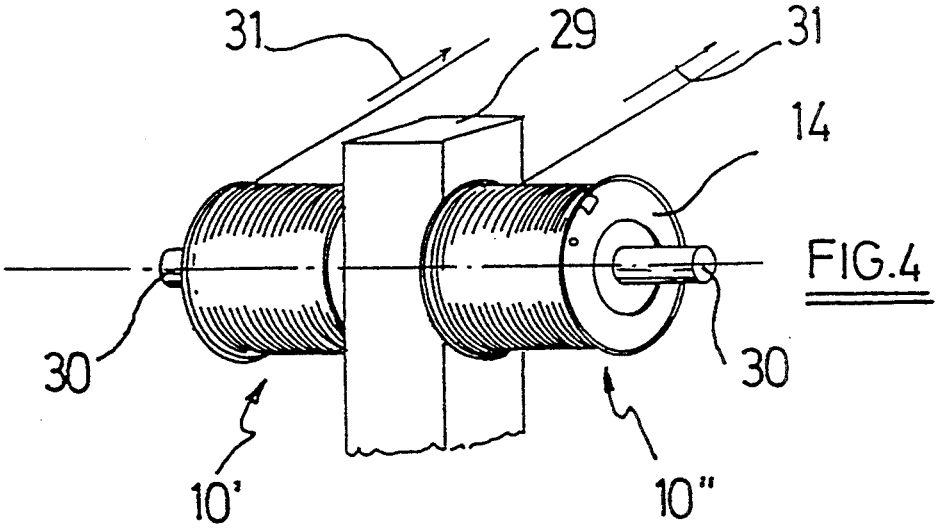
FIG. 4 shows schematically a unit for unwinding a spool filled with an elongated element.
Figure 5A:
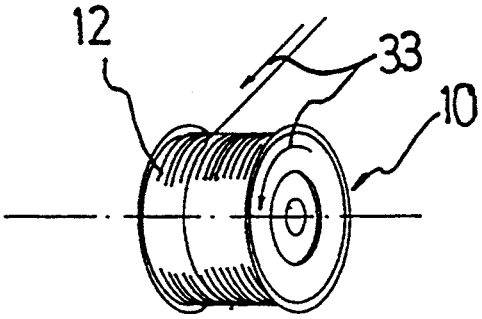
FIGS. 5(*a*) until 5(*h*) show schematically the steps of a method of winding an elongated metal element on a spool according to the second aspect of the present invention.
Figure 5B:
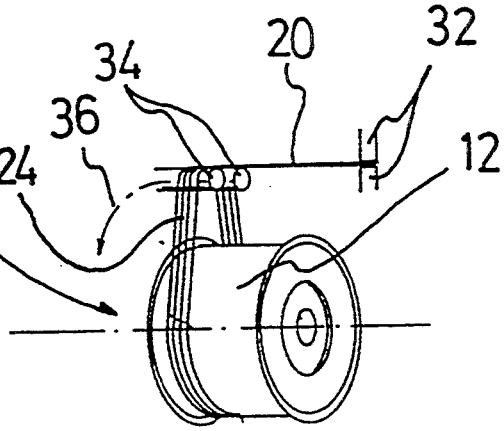
Figure 5C:
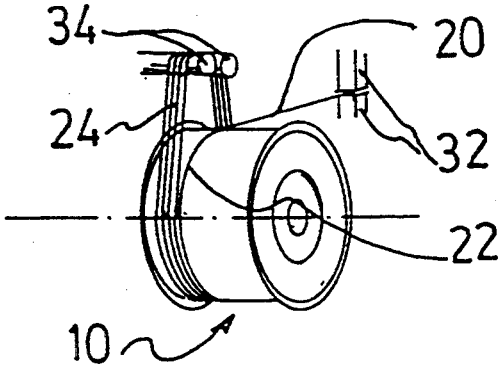
Figure 5D:
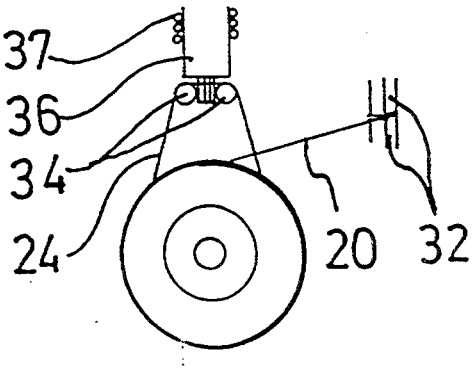
Figure 5E:
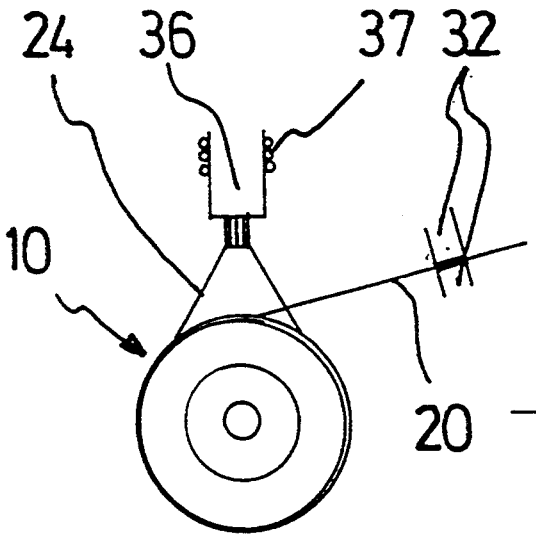
Figure 5F:
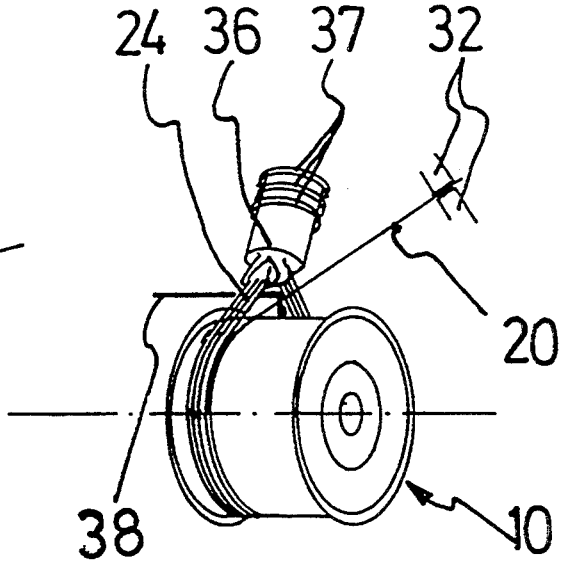
Figure 5G:
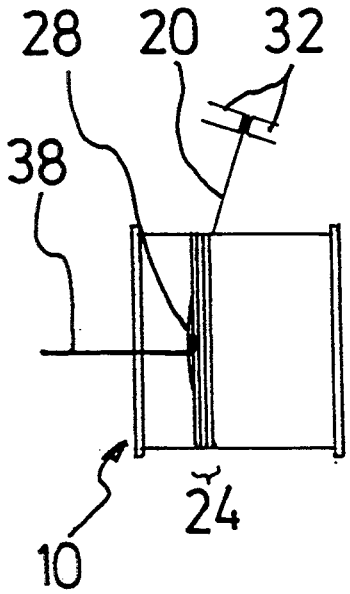
Figure 5H:
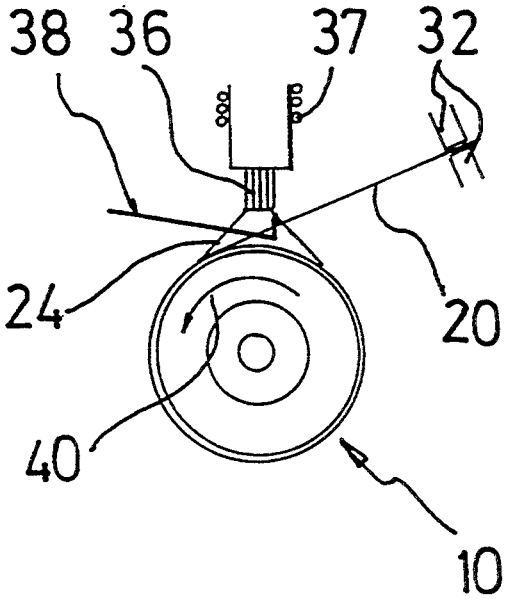

FIG. 4 shows schematically an unwinding unit comprising a central bar 29, on the left and the right side of which axles 30 have been provided. Spools 10' (left side) and 10'' (right side) are placed on these axles 30 in order to be unwound. If prior art spools according to FIG. 1 are used, the left spools 10' must be placed on the axles in a way that the flange 14 with the hole 16, the clamp 18 and the trailing end 20 is on the outermost left side and the right spools 10'' must be placed on the axles in a way that the flange 14 with the hole 16, the clamp 18 and the trailing end 20 is on the outermost right side. The reason is that near to the central bar 29 (i.e. for the left spool 10' the right side and for the right spool 10'' the left side) there is no space enough to do the handlings of releasing the trailing end 20 from the clamp 18 and of withdrawing the trailing end 20 through the hole 16. Since the unwinding is done for both left and right spools 10' and 10'' in the same direction 31, this means that the left spools 10' must have been wound in the other direction as the direction of winding of the right spools 10''. This may cause a lot of practical problems such as identifying what spools have to be placed where etc . . . Since with a spool according the present invention, the final winding 22 is fixed to the preceding windings 24 and not to one of the flanges, the direction of winding a right spool 10'' need not be different from the direction of winding a left spool 10'.

The way of securing the final winding 22 to the rest of the elongated element according to the invention has proved to be stable and reliable: even after several handling, storage and transport manipulations of a spool according to the first aspect of the invention, the final winding 22 remains, on the one hand, secured under the preceding windings 24, and, on the other hand, the final winding 22 can still be freed with a simple and short pull.

FIGS. 5(*a*) until 5(*h*) schematically show the different steps of the method of winding according to the second aspect of the present invention.

With reference to FIG. 5(*a*), the elongated element 12 is wound on spool 10 in a winding direction 33 with a high rotational speed. Once the spool 10 is full or once the desired weight has been reached, rotation of the spool 10 is stopped and the elongated element 12 is cut, thereby creating a trailing end 20 for the present full spool and a leading end (not shown) for the next empty spool (not shown). Referring to FIG. 5(*b*), the trailing end 20 of the elongated element 12 is held by means of a clamp 32, and two rollers 34 are positioned under the trailing end 20. These two rollers 34 are subsequently rotated with respect to the spool 10 in the direction of the arrow 36 over five turns in order to increase the length of the five last windings (i.e. the final winding 22 and the four preceding windings 24) and to create a space between the preceding windings 24 and the rest of the elongated element 12.

As shown in FIG. 5(*c*), the final winding 22 is subsequently removed from the two rollers 34 so that only the four preceding windings 24 remain on the two rollers 34.

With reference to FIG. 5(*d*), a pair of pliers 36 grips the four preceding windings 24. A spring 37 is connected to the pair of pliers 36 so that the pair of pliers 36 is subjected to a vertical force in the upward direction. This is done in order to hold the four precedings windings 24 constantly under tension.

With reference to FIG. 5(*e*), the two rollers 34 are subsequently removed from under the four preceding windings 24. In the next step, illustrated in FIG. 5(*f*), a gripper 38 is brought under the preceding windings 24 and grips the middle part 28 of the final winding 22. The gripper may consist of a small rod which has been properly bent.

As shown in FIG. 5(*g*), the gripper 38 brings the middle part 28 of the final winding 22 under the four preceding windings 24 in the space between the four preceding windings 24 and the rest of the elongated element.

Finally, as represented in FIG. 5(*h*), the length of the four preceding windings 24 is decreased by winding the spool 10 in the direction of the arrow 40 (winding direction). The space between the four preceding windings 24 and the rest of the elongated element is decreased and the pair of pliers 36 initially follows the movement of the four preceding windings 24 whilst maintaining the tension in the four preceding windings thanks to the spring 37. As soon as the space between the four preceding windings 24 and the rest of the elongated element has become small enough, the pair of pliers 36 releases the four preceding windings 24 which secure the middle part 28 of the final winding so that the gripper 38 can also be removed.

The above-mentioned movements of the different parts of the apparatus and for the different steps in the method may be carried out by hydraulic, pneumatic or electrical means, or by a combination thereof.

The spool and the method according to the invention have proved to function well for different kinds of metal wires and for different kinds of steel cord constructions, both for steel cord constructions with a wrapping filament and for steel cord constructions without a wrapping filament.

We claim:

1. An elongated metal element wound onto a spool with a plurality of windings;

the elongated metal element having a bending stiffness which is greater than 10 $Nmm^2$;

the plurality of windings ending with a final winding and n winding preceding the final winding;

n being greater than or equal to one;

the final winding comprising a beginning part, a middle part and a trailing end;

the middle part being a portion of the final winding under one or more of the n preceding windings, the middle part securing the final winding to the rest of the elongated metal elements;

the beginning part and the trailing end being at the same side of the n preceding windings;

wherein the final winding has a radius of curvature of at least 45 mm.

2. An elongated metal element according to claim 1, wherein the middle part extends over an angle which is greater than 90°, under at least one of the n preceding windings, said angle being measured from an axis of the spool.

3. An elongated metal element according to claim 1, wherein the angle is greater than 180°.

4. An elongated metal element according to claim 1, wherein the final winding has only parts which have been elastically deformed during the winding process.

5. An elongated metal element according to claim 1, wherein the elongated metal element has a specific gravity of at least 7 $kg/dm^3$.

6. An elongated metal element according to claim 1 wherein n is greater than or equal to two.

7. An elongated metal element according to claim 1 wherein n is greater than or equal to four.

8. An elongated metal element according to claim 1 wherein two adjacent windings have an axial distance between one another which is smaller than 10 mm.

9. An elongated metal element according to claim 1 wherein the n preceding windings are adjacent to each other.

10. An elongated metal element according to claim 1 wherein the spool has a filling degree which is smaller than 78 per cent.

11. An elongated metal element according to claim 1 wherein the trailing end is not longer than 50 cm.

12. An elongated metal element according to claim 1, wherein the elongated element is steel cord.

13. An elongated metal element according to claim 1 wherein the elongated element is steel wire.

14. A method of winding an elongated metal element in a plurality of windings onto a spool;

the plurality of windings ending with a final winding and n windings preceding the final winding;

n being greater than or equal to one;

the final winding comprising a beginning part, a middle part and a trailing end;

the method comprising the steps of:

(i) increasing a length of the n preceding windings while maintaining a tension in the n preceding windings in order to create a space between the n preceding windings and the rest of the elongated element;

(ii) holding the trailing end of the final winding fixed;

(iii) gripping the middle part of the final winding;

(iv) bringing the middle part of the final winding under the n preceding windings, in the space between the n preceding windings and the rest of the elongated element;

(v) decreasing the length of the n preceding windings while maintaining the tension in the n preceding windings in order to secure the final winding to the rest of the elongated element;

(vi) releasing the middle part of the final winding; wherein the length of the n preceding windings is decreased by rotating the spool in the winding direction.

15. A method according to claim 14 wherein the tension is greater than 10N and smaller than 100N.

16. A method according to claim 14 wherein the tension is smaller than one third of the breaking load of the elongated metal element.

17. A method according to claim 14 wherein the length of the n preceding windings is increased by (a) providing holding means which are located radially outward of the spool;

(b) positioning said holding means under the trailing end;

(c) rotating said holding means relatively to the spool in the winding direction over n+1 turns;

(d) moving the final winding from said holding means so that only the n preceding windings remain on said holding means.

18. An apparatus for winding an elongated element in a plurality of windings onto a spool;

the plurality of windings ending with a final winding and n windings preceding the final winding;

n being greater than or equal to one;

the final winding comprising a beginning part, a middle part, and a trailing end, wherein the final winding has a radius of curvature of at leaset 45 mm;

the apparatus comprising means for holding the trailing end fixed;

means for increasing the length of the n preceding windings;

means for gripping and releasing the middle part of the final winding; and means for decreasing the length of the n preceding windings.

19. An apparatus according to claim 18 wherein the means for gripping and releasing the middle part of the final winding are different from the means for increasing the length of the n preceding windings.

* * * * *